US005368299A

United States Patent [19]

Driska

[11] Patent Number: 5,368,299

[45] Date of Patent: Nov. 29, 1994

[54] PINBALL MACHINE BALL SPINNER

[75] Inventor: John Driska, Princeton Junction, N.J.

[73] Assignee: Azrak-Hamway International, Inc., New York, N.Y.

[21] Appl. No.: 14,457

[22] Filed: Feb. 5, 1993

[51] Int. Cl.[5] ..... A63F 7/30

[52] U.S. Cl. ..... 273/119 R; 273/119 A; 273/127 R; 273/129 R

[58] Field of Search ..... 273/118–125, 273/127 R, 127 C, 129 R, 129 S, 129.7

[56] References Cited

U.S. PATENT DOCUMENTS

| | | | |
|---|---|---|---|
| 2,872,193 | 2/1959 | Hamilton | 273/119 A |
| 3,203,699 | 8/1965 | Pearson, Jr. | 273/119 A |
| 3,975,019 | 8/1976 | Barlow | 273/121 A |
| 4,620,706 | 11/1986 | Ijidakinro | 273/122 R |
| 5,120,059 | 6/1992 | Oursler | 273/120 A X |

*Primary Examiner*—Vincent Millin
*Assistant Examiner*—Raleigh W. Chiu
*Attorney, Agent, or Firm*—Amster, Rothstein & Ebenstein

[57] ABSTRACT

In a pinball machine, a ball spinner comprising a cup adapted for rotation relative to a playing field, the cup having a curved inner surface which terminates in a peripheral flange, and a centrally disposed hub extending downwardly along the axis of rotation, the hub having a compression spring disposed thereof for maintaining the cup in a non-rotating, unweighted position, the cup being operably associated with a drive motor for rotation thereof, and being adapted to engage a switch upon sensing the weight of the pinball therein, the switch enabling the drive motor and remaining in a closed position until the pinball is ejected from the cup during rotation.

13 Claims, 3 Drawing Sheets

PINBALL MACHINE BALL SPINNER

BACKGROUND OF THE INVENTION

The present invention is generally directed to pinball machines, and more particularly, to a pinball machine which includes a ball spinner for engaging and randomly altering the travel path of a ball in play.

SUMMARY OF THE INVENTION

The present invention is directed to a ball spinner for use in conjunction with pinball machines or the like. The ball spinner is generally comprised of a molded cup rotatably mounted within the housing of the pinball machine, and is responsive to a ball in play. The cup includes a curved inner surface and is recessed bellow the playing field of the machine such that the ball can be captured therein. The cup is mechanically attached to a drive motor and, in a first embodiment, is adapted to translate vertically between a non-rotating, unweighted position, and a rotating, weighted position. When the cup senses the weight of the ball, its downward movement biases a microswitch into a closed position. The microswitch and the drive motor communicate with the pinball electronics. When the microswitch is closed, a scoring signal is generated and the drive motor is enabled to rotate the cup. As the cup rotates, the ball begins to spin and centrifugal force causes the ball to be ejected onto the playing field. The cup is attached to the housing with a spring loaded suspension system which normally urges the cup into the non-rotating, unweighted position. The cup may include a raised area integral with the curved surface to help kick the ball out of the cup during rotation. In a second embodiment, the drive motor is connected to a magnetic switch which is responsive to the presence of a metallic pinball. When the metallic pinball is within close proximity of the cup, the magnetic switch is tripped and the motor is enabled. When the ball is ejected from the cup, the switch opens and the motor is shut down.

In accordance with the present invention, it is an object thereof to provide a ball spinner for a pinball machine which is responsive to interaction with a pinball.

It is a further object of the invention to provide a ball spinner which includes a rotatable cup, a drive motor operably connected to the cup, and a spring loaded suspension system which permits the cup to translate between a non-rotating, unweighted position, and a rotating, weighted position.

It is another object of the invention to provide a ball spinner where a magnetic switch responsive to the presence of metallic pinball is connected to the drive motor such that the cup rotates when the ball is in close proximity thereto.

It is still a further object of the invention to provide a ball spinner which includes a cup having a curved surface with at least one integrally molded radial rib to facilitate ball ejection.

In accordance with these and other objects which will become apparent hereinafter, the invention will now be described with particular reference to the accompanying drawings.

DETAILED DESCRIPTION OF THE PREFERRED EMBODIMENT

Figure 1:
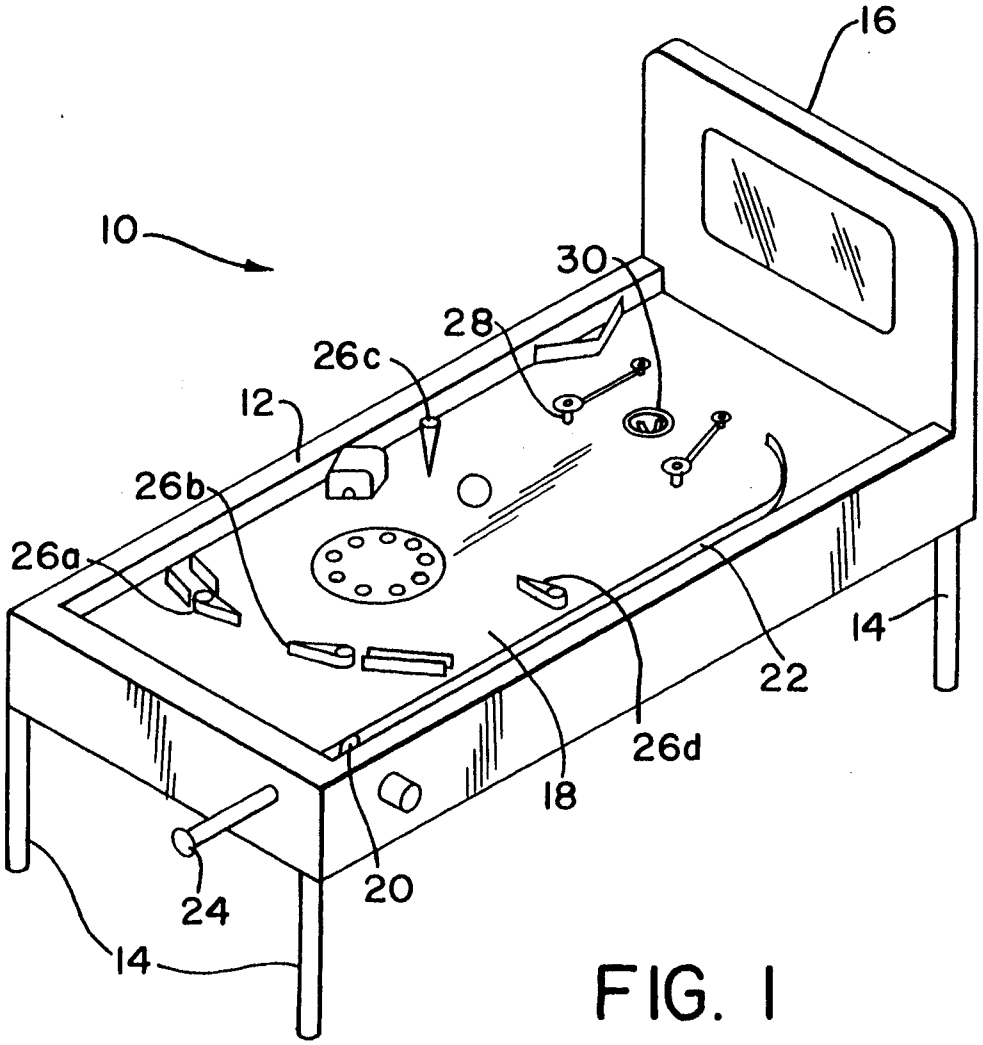
FIG. 1 is a perspective view of a pinball machine with a ball spinner.

With reference to the several views in the drawings, there is depicted a pinball machine generally referred to by the reference numeral 10. Pinball machine 10 is of the type known in the art, and is generally comprised of a housing 12, support elements 14 and a backboard 16.

Referring to FIG. 1, housing 12 includes a playing field 18 onto which a ball 20 is discharged from guide slot 22 in the conventional manner. The ball 20 is propelled upon releasing a spring loaded plunger 24, and remains in play until being lost by bypassing flippers **26*a* and 26*b*. A plurality of bumpers 28 and other targets and/or flippers 26*c* and 26*d* may be located on playing field 18** in accordance with known pinball machine design.

Figure 2:
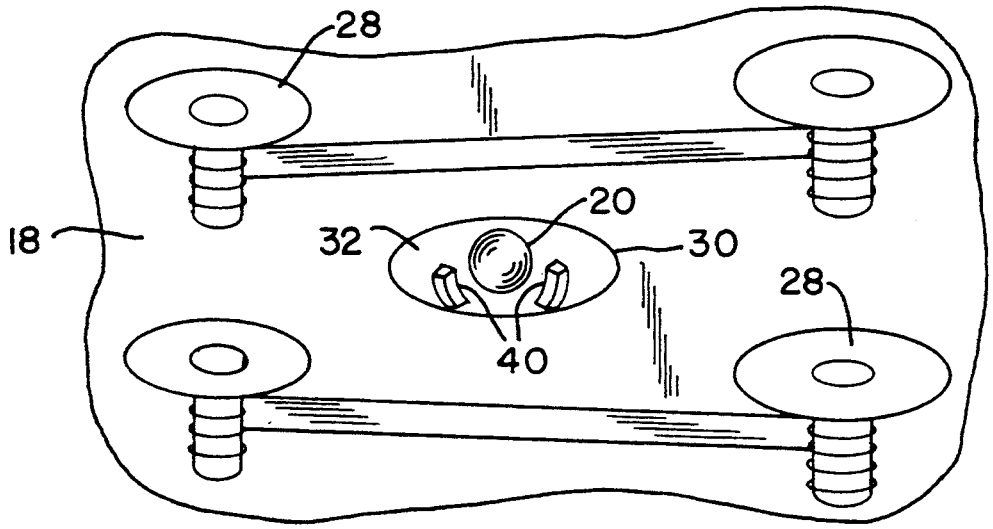
FIG. 2 is an enlarged perspective view of the ball spinner.
Figure 3:
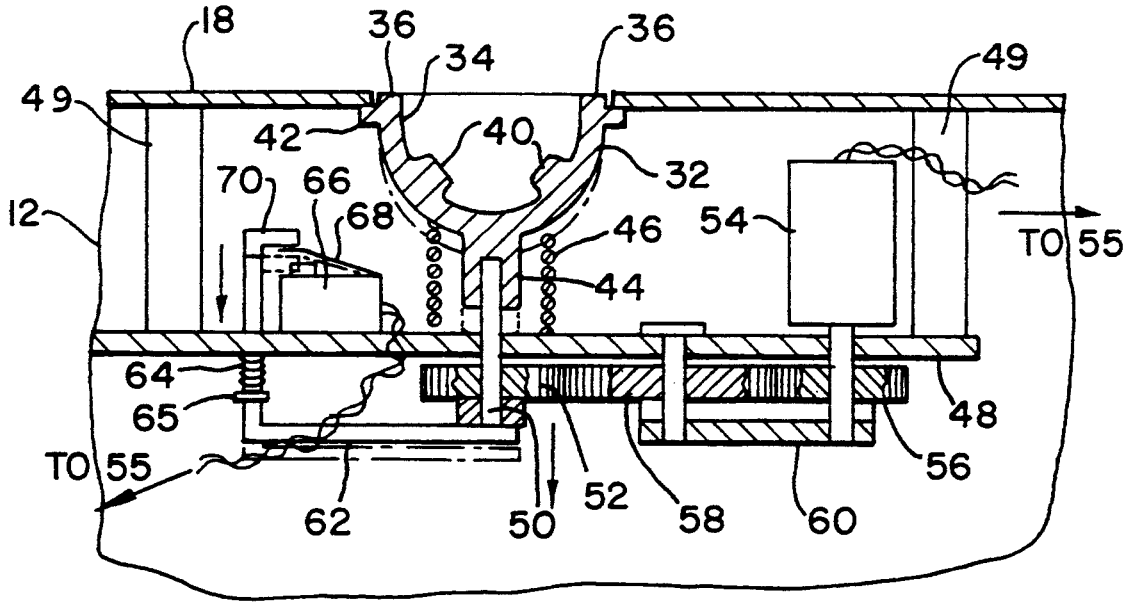
FIG. 3 is a sectional view of the cup in one embodiment.
Figure 4:
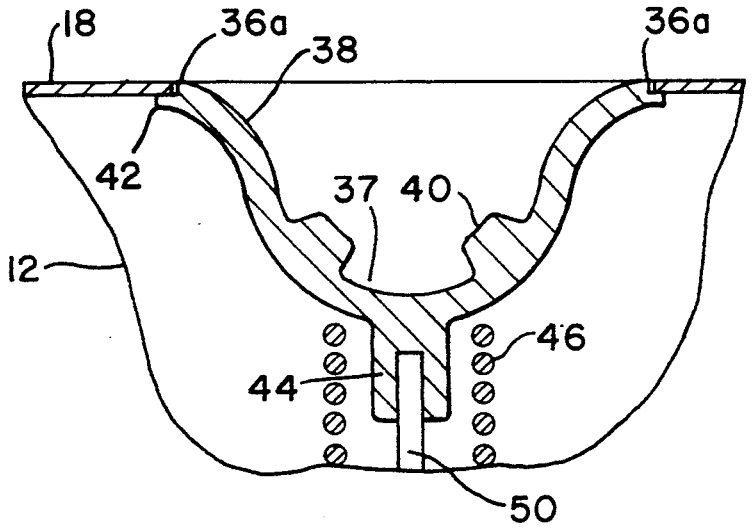
FIG. 4 is a sectional view of the cup in a second embodiment.

Referring to FIGS. 2, 3 and 4, the invention is directed to a ball spinner 30 which provides a novel means of directing the ball 20 about playing field 18 in a random and unpredictable manner. The ball spinner 30 is comprised of a cup 32 which is strategically disposed on playing field 18, such as between bumpers 28 as shown in FIG. 2. Cup 32 includes a curved inner surface 34 which terminates in a peripheral lip 36, preferably disposed flush with the playing field 18. In one embodiment, the curved surface 34 is generally convex throughout as shown in FIG. 3. In another embodiment, the curved surface 34 has a concave portion 37 in the bottom area of the cup, and a convex portion 38 blending with the concave portion and extending radially toward the peripheral lip **36*a* as illustrated in FIG. 4. At least one raised area such as rib 40 is integrally molded in cup 32, and extends radially along surface 34 towards peripheral lip 36. When cup 32 rotates, ball 20 is spun until centrifugal force causes it to be ejected from cup 32 and back onto playing field 18. The rib 40 interacts with ball 20, and helps to kick the ball out of cup 32**.

Cup 32 includes an integral, circumferential flange 42 proximal to peripheral lip 36, and a hub 44 which extends downwardly along the axis of rotation. A compression spring 46 is axially disposed around hub 44, such that it is situated against cup 32 and bracket 48. Bracket 48 provides a means for rotatably mounting cup 32 relative to housing 12, and is attached to housing 12 by supports 49. Hub 44 includes an elongated shaft 50, which extends through an aperture in bracket 48, and which has a drive gear 52 attached at the bottom end thereof. A motor 54 is fixedly attached to bracket 48. Motor 54 is connected to the pinball electronics generally denoted by the reference number 55. Motor 54 drives cup 32 through a gear train which includes a pinion gear 56, an idler gear 58, and a drive gear 52. Idler gear 58 and pinion gear 56 are retained by secondary support bracket 60 as shown in FIG. 3. In a first embodiment, the drive gear 52 and shaft 50 are free to translate vertically between a non-rotating, unweighted position, and a rotating, weighted position when the ball 20 is captured within cup 32. Accordingly, there is some play between gears 52 and 58, such that some relative vertical motion is permitted while still remaining in engagement. An "L" shaped member 62 is disposed through an aperture in bracket 48 with a compression spring 64. Compression spring 64 is held against bracket 48 by flange 65 in member 62. A microswitch 66 having a flexible strip 68 is strategically located on bracket 48. Microswitch 66 communicates with the pinball electronics 55. Switch 66 is closed when the hook portion 70 of member 62 is urged downward when cup 32 is biased into the rotating position upon sensing the weight of ball 20. This generates a scoring signal, and sends an enabling signal through the electronics 55 to motor 54. Motor 54 spins cup 32 through the gear train comprised of pinion 56, idler 58 and drive gear 52 as described above. When the ball 20 is ejected from cup 32, the compression spring 46 returns cup 32 to the non-rotating, unweighted position, with the circumferential flange 42 making contact against the underside of playing field 18.

Figure 5:
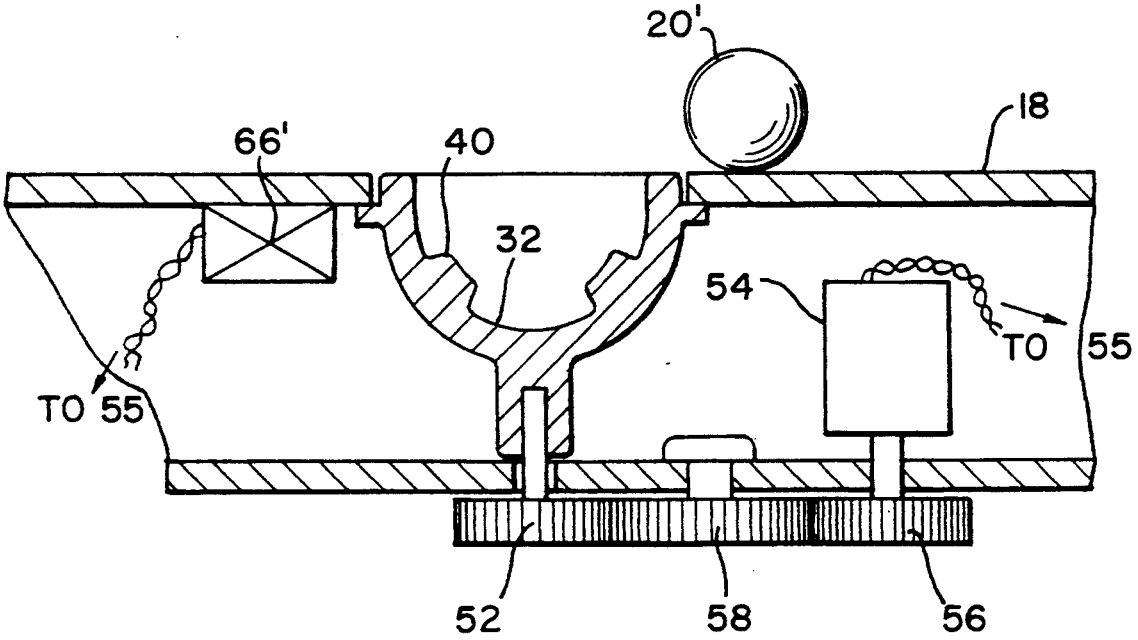
FIG. 5 is a sectional view of the cup showing another switching embodiment.

Referring to FIG. 5, in another embodiment, a magnetically triggered switch 66 of the type known in the art is used in lieu of the vertically translating mechanism described above. Magnetic switch 66' is responsive to the presence of a metallic pinball 20' such that cup 32 rotates whenever ball 20' comes within close proximity of magnetic switch 66'. The magnetic switch is disposed at a suitable location relative to cup 32, such that it will be triggered by the presence of ball 20'.

Referring now to FIG. 2, there are shown four bumpers 28 which are located proximal to spinner 30. An elongated elastic material 74 may be attached between adjacent bumpers 28 to engage the ball 20 upon ejection. In this manner, the ball 20 may be randomly directed between the bumpers 28 and the ball spinner 30.

The present invention has been shown and described in what is considered to be the most practical and preferred embodiment. It is anticipated, however, that departures may be made therefrom and that obvious modifications will occur to a person skilled in the art.

I claim:

1. In a pinball machine having a playing field on which a ball travels, a ball spinner comprising:

a cup adapted for rotation about an axis relative to said playing field, said cup having an inner surface which terminates in a peripheral rim and at least one raised area on said inner surface; and means for rotating said cup operably associated with said pinball machine.

2. The ball spinner recited in claim 1, wherein said means for rotating said cup are responsive to the presence of said ball.

3. The ball spinner recited in claim 1, wherein said inner surface includes concave and convex portions.

4. The ball spinner recited in claim 1, wherein said raised area is a radially disposed rib extending outwardly towards said peripheral rim.

5. The ball spinner recited in claim 1, further comprising means for scoring responsive to ball contact with said cup.

6. In a pinball machine having a housing and a playing field on which a ball travels, a ball spinner comprising:

a cup adapted for rotation about an axis relative to said playing field, said cup having a curved inner surface which terminates in a peripheral rim wherein said peripheral rim of said cup is generally aligned with said playing field and said curved inner surface includes concave and convex portions which are disposed below said playing field within said housing; and means for rotating said cup operably associated with said pinball machine, said means for rotating being responsive to the presence of said ball.

7. The ball spinner recited in claim 6, wherein said means for rotating said cup comprises spring means for normally maintaining said cup in a non-rotating position relative to said playing field in a unweighted condition, and which permit said cup to be moved into a rotating position relative to said playing field in a weighted condition during ball contact; switch means for generating an enabling signal when said cup is biased into said rotating position; and motor means being responsive to said enabling signal operably associated with said cup for rotation thereof.

8. The ball spinner recited in claim 7, wherein said switch means generates a scoring signal when said cup is biased into said rotating position.

9. The ball spinner recited in claim 7, further comprising bracket means for rotatably mounting said cup relative to said housing, and wherein said cup further comprises a circumferential flange disposed proximal to said peripheral rim which engages a portion of said housing when said cup is in said non-rotating position, and a centrally disposed hub extending downwardly along said axis of rotation, said spring means being axially aligned about said hub such that contract is made with a portion of said cup and a portion of said bracket means.

10. The ball spinner recited in claim 9, wherein said hub of said cup includes a shaft extending through said bracket means, and said connection between said motor means and said cup comprises a gear train wherein said motor rotates a drive gear attached to said shaft, said drive gear and shaft adapted for vertical movement relative to said gear train such that said switch means are biased into a closed position during ball contact.

11. The ball spinner recited in claim 7, further comprising at least one radially disposed rib extending outwardly towards said peripheral rim.

12. The ball spinner recited in claim 6, wherein said means for rotating comprises magnetic switch means responsive to the presence of said ball for generating an enabling signal and motor means being responsive to said enabling signal operably associated with said cup for rotation thereof.

13. In a pinball machine having a housing and a playing field on which a ball travels, a ball spinner, comprising:

a cup adapted for rotation about an axis relative to said playing field, said cup having a curved inner surface which terminates in a peripheral rim, said cup defining a circumferential flange disposed proximal to said peripheral rim, and a centrally disposed hub extending downwardly along said axis of rotation;

bracket means for rotatably mounting said cup relative to said housing; and means for rotating said cup operably associated with said pinball machine, said means for rotating comprising spring means for normally maintaining said cup in a non-rotating position relative to said playing field in an unweighted condition, and which permit said cup to be moved into a rotating position relative to said playing field in a weighted condition during ball contact; switch means for generating an enabling signal when said cup is biased into said rotating position; and motor means being responsive to said enabling signal which are operably associated with said cup for rotation thereof.

* * * * *